US006145349A

United States Patent [19]

Sciacca

[11] Patent Number: 6,145,349

[45] Date of Patent: Nov. 14, 2000

[54] METHOD AND EQUIPMENT FOR JACQUARD SELECTION IN A TEXTILE MACHINE

[75] Inventor: Franco Sciacca, Como, Italy

[73] Assignee: Pilotelli Macchine Tessili S.R.L., Italy

[21] Appl. No.: 09/355,512

[22] PCT Filed: Jan. 30, 1998

[86] PCT No.: PCT/IT98/00014

§ 371 Date: Jul. 28, 1999

§ 102(e) Date: Jul. 28, 1999

[87] PCT Pub. No.: WO98/33966

PCT Pub. Date: Aug. 6, 1998

[30] Foreign Application Priority Data

Feb. 4, 1997 [IT] Italy ..... CO97A0002

[51] Int. Cl.[7] ..... D04B 15/66

[52] U.S. Cl. ..... 66/220; 66/219; 66/216

[58] Field of Search ..... 66/8, 13, 15, 38, 66/216, 218, 220, 221, 222, 227, 123

[56] References Cited

U.S. PATENT DOCUMENTS 3,851,500 12/1974 Wolfshagen ..... 66/220

3,971,233 7/1976 Amay et al. ..... 66/220

5,361,608 11/1994 Salucci et al. ..... 66/220

FOREIGN PATENT DOCUMENTS 290897 11/1988 European Pat. Off. ..... 66/220

*Primary Examiner*—Danny Worrell

*Attorney, Agent, or Firm*—McGlew and Tuttle, P.C.

[57] ABSTRACT

The invention relates to Jacquard selection in a textile machine characterized by a selection jack (1) provided with a spring (M1) by which, after the preselection phase in which the jacks are guided by a cam inside the cylinder, they move out under the pressure of the spring, thus modifying the path or the functions; or remain contained and/or retained in the cylinder by a selector and/or other member disposed frontally which prevents their moving out. According to circumstances, the selector, even if fixed, can move vertically, horizontally and also radially, with minimum time and space, without lateral impact on the incoming butts and/or jacks. Finally, the actuators, together with the cams of the jacks and/or needles, are incorporated in a modular support to modify the type of selection and/or for textile operations other than the Jacquard type.

20 Claims, 4 Drawing Sheets

METHOD AND EQUIPMENT FOR JACQUARD SELECTION IN A TEXTILE MACHINE

BACKGROUND OF THE INVENTION

An increasing number of textile machines are provided with Jacquard devices for the production of fabrics with designs or ornamental motifs produced during the weaving or knitting phase by the selection of appropriate moving parts, according to the general principle of modifying the position and/or the path of the part in question (needle, jack or under-needle, sinker, heald, and similar). Essentially, a conscious discrimination is made between opposite positions and/or commands such as "inside-outside", "up-down", "north-south", and similar. In stocking and circular or flat knitting machines, with rotating cylinders and stationary cams or vice versa, the selection jack is usually provided with one or more butts against which an external device, actuator and/or selector acts. Normally, there is an impact between the latter and the stub of the incoming jack (in other words between moving and fixed parts or between moving parts only), the force of which varies with the operating speed and produces violent lateral impacts, vibrations, acceleration, heat, friction and wear in excess, which sometimes cause mechanical breakages. However, in addition to the said lateral impact, the normal selection is characterized by other limits which are even more evident in fast machines. One of these is represented by the necessity of widening the selection window or region, since, owing to the speed, the impact of the butts of the jacks on the raising cam must take place with a slight inclination, which may be less than 20 degrees. Another limit is set by the width of the selector (and the corresponding lateral inclined plane) which may be as much as 10 mm or more, this being necessary to allow the jack to complete its path, in other words to abruptly re-enter the cylinder or needle bed, passing behind the raising cam, without damage, in time. Another limit is represented by the fact that, after the impact with the external selector provided with the usual inclined plane, the jack violently re-enters towards the cylinder and is practically free, and therefore subject to strong recoils and vibrations. Another limit is represented by the fact that, independently of the operating speed, the normal width of the said selector complete with inclined plane does not permit the disposition of the jack butts very close together, for example, the use of a single selector of the actuator to select all the jacks, 13–13*a*, FIG. 21, in a similar way to the single-magnet device. A further limit is represented by the fact that electronic machines remain definitively characterized and conditioned by the original selection method, whether single-magnet device or actuators. Since each of these systems offers its own advantages, known to experts (rapid change of gauge, costs and wear of the materials, needle selection with two or three technical ways, and others), that a modern knitting factory must be flexible and rapidly adaptable to the changing market requirements with Jacquard and other types of production, it appears advantageous to have available a versatile machine capable of using, according to circumstances, various and/or different selection systems, or of producing different knitted structures at high speed.

SUMMARY AND OBJECTS OF THE INVENTION

On this assumption, a primary object of the present invention consists in the provision of a method and the corresponding equipment for Jacquard selection in a textile machine by means of a suitable and programmed frontal contraposition between moving parts and/or moving and fixed parts.

Another object consists in the reduction and/or elimination of many of the violent impacts, especially the lateral impacts, between moving parts and/or between moving and fixed parts. Another object consists in the elimination of the inclined plane of the selector or plunger, the point of impact and deviation for the incoming jacks and/or of the selector itself, which is replaced by appropriate extension of the keeper of the electromagnet and/or in any case the moving member-acting directly on the jack.

Another primary object consists in the provision of a method and the corresponding equipment for improving the selection with the jack and/or other similar part, even in the temporary "active preselection" position, in other words only partially on the raising cam and/or on its path.

Another object consists in the incorporation of the actuators and/or of other selection devices, with the corresponding cams for preselecting and/or for raising the jacks and/or under-needles and/or sinkers and/or needles in a single support for each feed or groups of feeds, with the further objective of replacement or rapid interchangeability with a similar support for different knit selections, or for high-speed textile operations. Another object consists in the predicted reduction of friction, heat and/or noise, in addition to lubrication, with more efficient and safe performance. An additional object consists in the provision of a method and the corresponding equipment for decreasing the width of the selection area to the nominal gauge or less, to guide the jacks appropriately and/or reduce their vibration and recoils during selection. Other objects will be revealed by the description, examples, drawings and claims, individually or as a whole.

These results may be achieved in various ways and the present description, which is purely descriptive and not restrictive, is centred by preference on the widespread system of electrical actuators acting from the outside on the butts of the incoming jacks.

The invention is defined by providing a needle bed with a plurality of mobile parts, such as jacks, for formation of fabric. The mobile parts are movable between an inner and an outer position with respect to the needle bed. A spring or other elastic structure is used to bias the plurality of mobile parts toward to the outer position. All of the plurality of the mobile parts are then sequentially moved towards the inner position by a pre-selection cam. Individual mobile parts are then selected to move in to the outer position by the biasing. This selecting is performed by a selector means which either allows the mobile part to move in to the outer position or blocks the mobile part from moving into the outer position. A raising cam then raises the selected mobile parts that are in the outer position. The non-selected mobile parts are kept disengaged or separate from the raising cam.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 19:
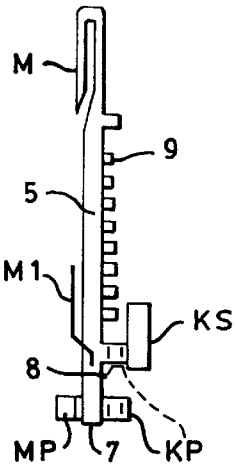
FIG. 19 show a different embodiment of a jack.

The invention is preferably applied with moving members such as jacks, needles, sinkers and similar, provided with individual and/or common springs, acting at the moment at which the said jack enters the critical selection position. The force, or pressure, is produced either by the temporary structural deformation of the jack (known as an elastic jack) and/or part of it, or by a separate and/or general spring, similar to those of the needle cylinders, or by a band of rubber and/or other suitable material, which may be filled with gas or liquid, capable of pushing back the jack by reaction. The latter may be of the type oscillating at the lower end from and towards the cylinder with a vertical undulating motion, 5 in FIGS. 15 and 19; or oscillating at the upper end, 1–1*a* in FIG. 1, possibly provided with a fork and/or zigzag which houses and/or controls the adjacent and/or overlying under-needle or sinker, 3 in FIG. 1; or a jack with both ends oscillating, like 1 in FIG. 9. In general, the said jacks, which are already outside the cylinder, in the pre-selection area are progressively guided and/or squeezed by at least one cam or inclined plane which may be also inserted in or fixed to the support of the actuator GA, FIG. 2. Moreover, the invention preferably uses known selection devices such as the said electrical actuators and others: electromechanical, magnetic, piezoelectric, ceramic, or pneumatic devices and/or linear motors; or selection wheels or pattern drums, groups of fixed or movable selectors for minijacks machines, and similar, characterized by positions, movements, rotations, oscillations, impulses or vibrations according to an operating and/or design program.

Figure 1:
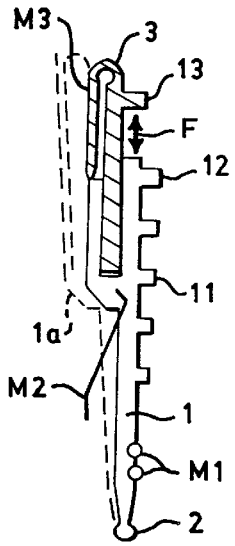
FIG. 1 shows an embodiment of an elastic jack.

The invention preferably produces a "soft" approach, free of violent lateral impacts between the incoming jacks and the selectors disposed at the feeds. In one of the preferred embodiments, a selection jack, 1 in FIG. 1, is used, and oscillates at the upper end in position 1*a*; it is provided with cylinder or general springs such as M1, or individual springs such as M2, M3 and/or 21–22 in FIG. 8 (elastic jack). It is also provided with one or more selection butts 11 and the preselection butt 12, and is characterized by the presence of at least one under-needle or overlying member 3, guided and slidable in the direction of the arrow F, and provided in turn with at least one raising butt 13. At the operating and/or selection points, the said jack 1 is pushed by an inclined plane K2, FIGS. 2–3 (and 5–6–13), towards the 33 inside of the cylinder or needle bed, so that the butt 13 assumes the position 13*a*1, where it is completely excluded, or 13*a*, so that the point or edge of the butt 13 is disposed partially on the raising cam K fixed to the support 10. In the selection area corresponding to the butt 13*a* and 13*a*1 in FIG. 3, the movable selector or actuator L inserted in the corresponding actuator unit GA operates immediately after the cam K2. In the active position, L in FIG. 2, it acts on the selection butt 11 of the jack to prevent it from moving out. The jack 1, when freed from the constraining force of the cam K2, tends to move out under the force of the individual or general spring. In practice, therefore, the selector L acts as a stop, wall or limit, so that the jack continues its travel without modifying its trajectory or path. In the opposite case, the inactivity of the selector or actuator L1 in FIG. 2, housed in the actuator unit GA, does not interfere with the automatic outward movement of the jack which continues on the raising cam K in position 13*b* in FIGS. 2 and 3. The phases described are further illustrated in detail in FIGS. 5 and 6 in relation to the jack 1 of FIG. 4, provided with various spring(s) such as M1–M2–M3–M4 and a under-needle 3, which is vertically slidable in the direction of the arrow F and is structurally elastic at the point M5 if subjected to appropriate pressure and/or bending.

Figure 5:
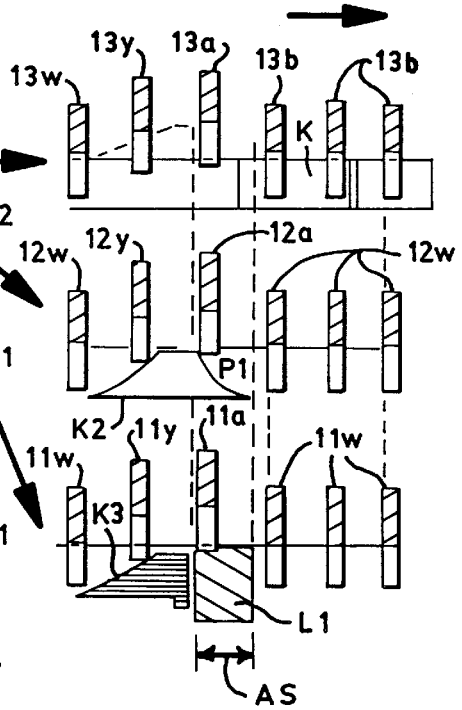
Figure 6:
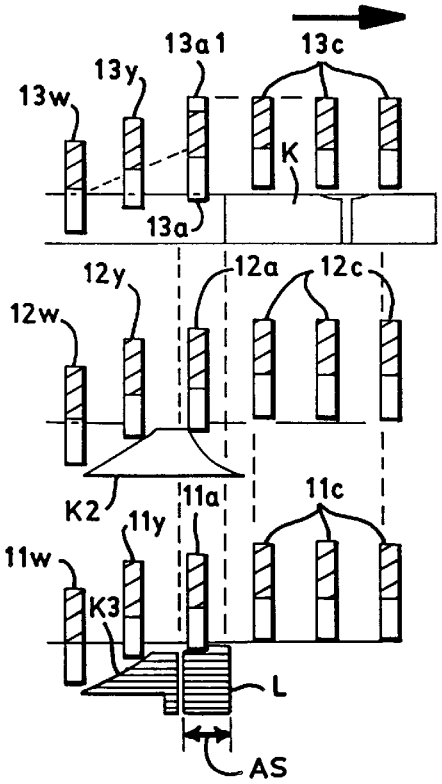
Figure 9:
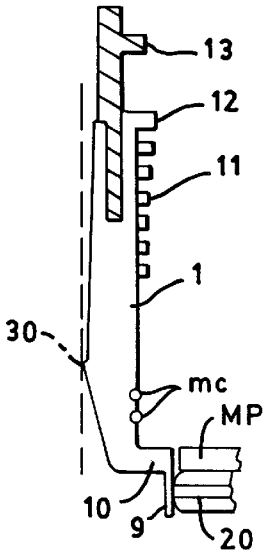
Figure 10:
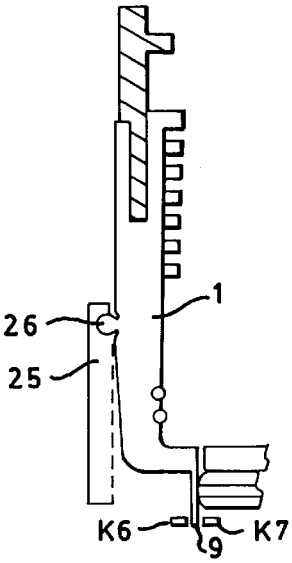
Figure 11:
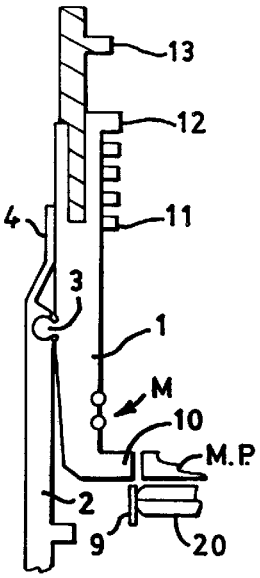
Figure 12:
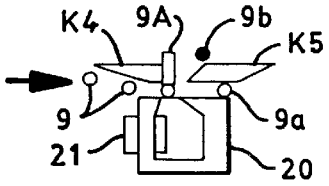
FIG. 12 show an embodiment with an electromagnetic selector.
Figure 13:
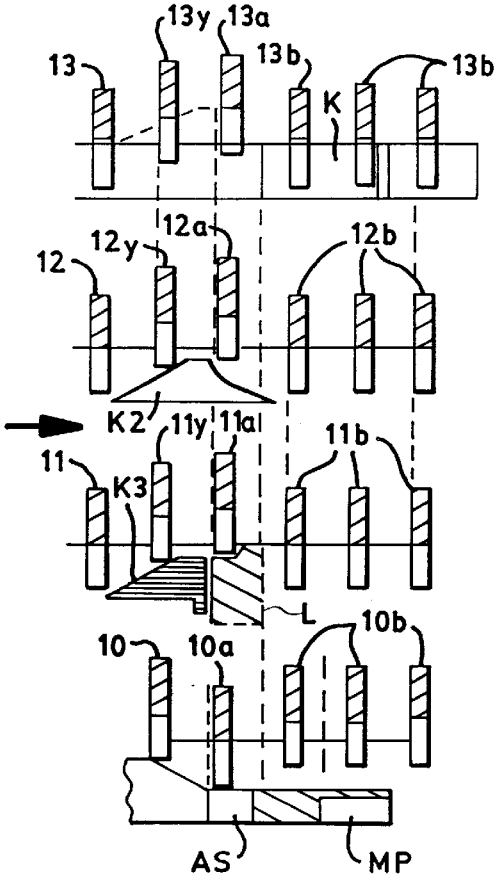
FIG. 13 show the movements of jacs and under-needle arranged therebelow.
Figure 20:
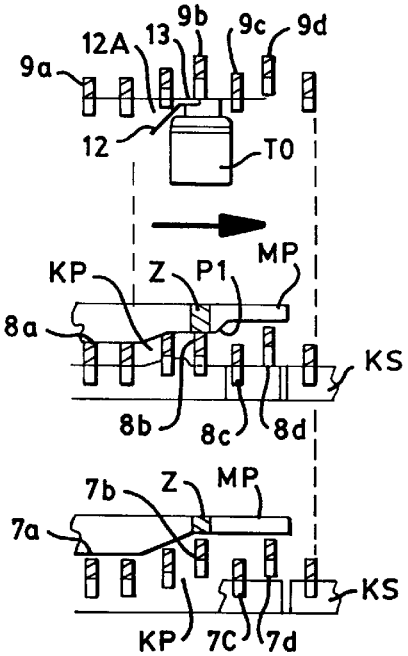
FIG. 20 show the operation of a lifting cam.

The jack 1 oscillating on the upper end is provided with selection butts 11, a preselection butt 12 and a raising butt 13, seen in plan view in FIG. 5. In the case in question, the cam K2 presses and progressively moves all the incoming butts 12*w* into the positions 12*y* and 12*a*. This movement naturally also affects the position of the under-needle above, whose butt 13*w* modifies its path, first at 13*y* and then at 13*a*. In this phase, the selector or actuator acting on the selection butts 11, in the selection area AS, remains inactive, in the position Ll. Consequently the butt 12*a*, pushed by its spring and/or other force, returns to its natural external position, preferably following the inclined exit plane of the cam K2, indicated by P.I. This movement obviously affects the position of the under-needle 13*a* above, which continues its travel on the raising cam K, as 13*b*, in a similar way to FIGS. 2 and 3. FIG. 6 differs from 5 in that it shows the active position of the selector or actuator L, which, being disposed in the selection area AS, performs different functions, according to the invention. The said selector L retains and/or maintains the corresponding butt 11*a* in its current position, in such a way that the butt above, 13*a*, remains constantly behind the line of the raising cam K as shown at 13*c* and in a similar way to 13*a*1 in FIG. 2. In other words, the said selector L, being also provided with a small frontal inclined plane, pushes the butt 11*a* (13*a*), which is already partially on the cam K or its path, further into the position 13*c*. To summarize, by coordinating the positions of the butts 11*a*, 12*a*, 13*a* with the preselection cam K2 and the function and/or frontal profile of the selector L, the Jacquard selection takes place in a linear way, the raising butt 13*a* being kept behind the cam K as shown at 13*c*; alternatively, the said selection is partially modified by the introduction of a temporary phase of "active preselection" characterized in that the raising butt 13*a* is disposed initially partially on the path of the raising cam K, and therefore properly advanced, but is otherwise ready to be pushed back again beyond and behind the raising cam K by the selector L, whose pressure or force overcomes the pressure or force of the jack. The inclined plane or cam K3 disposed immediately before the selectors L–L1 (FIGS. 5–6) preferably performs functions of protecting the selectors and in the case in question does not come into contact with the incoming butts (see also 12 and 12*a* in FIGS. 16 and 18). If any jacks break, this inclined plane guides any unexpected and uncontrolled incoming butt or fragment into the cylinder or needle bed; if isolated and connected suitably to the circuit of the stops, it also acts as a stop device in case of contact with unexpected metal parts. The invention substantially modifies the moving selector normally inserted in the cited selection devices or conventional actuator units, for example those with 8 levels, in at least two aspects, by separating and/or eliminating the lateral inclined plane, which is merely preparatory and is a cause of breakage, from the selector itself with the functions of pushing and guiding the butt of the jack in the cylinder or needle bed and holding it there, appreciably reducing the load and mass in movement so that even a conventional actuator benefits from this in terms of production and operating costs, with better and safer performance. In another preferred embodiment, the invention uses the jack 1, shown schematically in FIGS. 9–10–11, and differing from the preceding jack in that it is essentially hinged and/or pivoted in the middle lower part so that it oscillates at both ends. In FIG. 9, the jack 1 consists of the lower appendage 9 against which there acts an electromagnet 20 and/or a cam also formed by a permanent magnet MP on which the lower butt 10 runs. The jack 1 is pivoted at the point 30 on the needle cylinder or at the bottom of the slits or bars; it is provided with one or more cylinder springs mc capable of returning the said jack; finally the normal butts for selection 11, preselection 12 and raising 13 are present. FIG. 10 shows the jack 1 hinged at the point 26 on a fixing member inserted into the bars of the cylinder, which is not shown. The appendage 9 also follows the profiles of the adjacent inclined planes K6 and K7. In FIG. 11, the said jack differs further in that it is hinged at 3 to the member inside the cylinder 2, which is also provided with an elastic appendage 4. FIG. 13 is a plan view of the movements of the jacks and the under-needles above in the new and different configuration characterized by the jack 1 which oscillates at both ends. The preselection butts 12 encounter the inclined plane or cam K2 which diverts their path to 12*y* and 12*a*. The selector L, being inactive, does not hinder the return of the jack to the original position, and the raising butts 13, after a brief diversion to 13*y* and 13*a*, rise on the cam K. At the same time, the lower butt 10, having moved past the selection area AS, continues as at 10*b*. Otherwise, the selector L, being active, contains, retains and/or pushes the butt 11*a*, consequently moving the raising butts 13 (not shown) away behind the cam K. In this position, in FIG. 14, the lower butt 10, after the selection area AS, continues to be in contact with and/or attracted by the force of the permanent magnet MP. The configuration described is completed in a different embodiment with the use of the electromagnet 20 in FIG. 12, provided with a coil 21 which, when energized according to the operating program, momentarily removes the magnetic field through which pass the lower appendages 9 pre-loaded by the raising cam K4 up to the selection area 9A. Normally, the permanent magnetic field retains the said appendages and forces them to continue as at 9*a*; the momentary removal of the magnetic field in the selection area allows the appendage 9*a* to return to 9*b*, this being facilitated by the diverting cam K5. In a different embodiment of the invention, the jack 5 in FIG. 15, oscillating at the lower end with an undulatory motion, provided with spring (s) M1–M2–M3, a raising butt 8 and a selection butts 9 with a pointed lower end 7, is normally disposed in the position indicated by 7*a*–8*a*–9*a* in FIG. 18. In the preselection area, the jack 5 is pushed by the cam 14*a* and/or 14*b* (and/or 15*a*) which may be movable and/or adjustable from the outside by means of suitable control equipment, towards the needle bed so that the said parts 7*a*–8*a*–9*a* assume the inner positions 7*b*–8*b*–(8*b*1)–9*b*. In the case in question, the selector 13, in FIGS. 16–18, oscillating vertically and/or horizontally, acts as a stop, limit, or wall to the selection butt 9*b*, which is held there, and continues its travel as shown at 9*d*, 8*d* and 7*d*. With the selector 13 inactive, the butt 9*b* pushed by the spring and/or by combinations of pressure, 313 fulcrum or lever, or by an elastic jack provided with an appendage and/or zigzag capable of imparting to it an intrinsic structural elasticity, moves out, modifying its path abruptly at 9*c*, FIG. 18. Consequently, the parts 8 and 7 also assume the positions 8*c* and 7*c*, with the aid of the corresponding cams 16, KS and/or the corresponding selector and/or electromagnet. The resting or inactive position of the selector 13 allows the jack to move out, being pushed back by the spring, and then to rise on the corresponding cam KS as at 8*c*, also in FIG. 17. The selection is then achieved by means of the position of the selector 13 which prevents the selection butt 9*b* from moving out; alternatively, the unselected jacks move out of the cylinder automatically under the action of the individual or general springs. In the case in question, the lower part of the jack 7, being rather pointed, has the purpose of ensuring that the selection procedure takes place both by diverting the trajectory from 7*b* to 7*c* with the aid of the diversion cam 16 and by retaining the inactive jacks 7*d* with the additional aid of the permanent magnet MP adjacent to the selection area Z. An additional embodiment of the present invention is schematically illustrated by the jack 5 of FIG. 19 which differs from the similar jack in FIG. 15 in that it is structurally elastic at M, and is provided, if necessary, with another spring such as M1. This jack oscillates at the lower end, following the preselection cam KP, and is retained if necessary by the permanent magnet MP, both of these being disposed on the lower end 7 or otherwise, for example against the raising butt 8. Normally, the jack 5 follows the raising cam KS when the selection butts 9 are not pushed by the corresponding selectors, as indicated in FIG. 20. The incoming jack 7*a*–8*a*–9*a* is diverted to the interior of the needle bed to the position 7*b*–8*b*–9*b*, in the selection area and/or nominal gauge Z. The selector 13, being inactive in respect of 9*b*, does not impede the automatic outward movement of the jacks compressed previously, which follow the raising cam KS. Conversely, with the active selector L against the butt 9*b*, the butts 7*b* and/or 8*b* below remain behind the raising cam KS, being further attracted to and/or maintained in this position by the force of the adjacent permanent magnet MP, provided if necessary with a suitable inclined plane P.I. capable of facilitating the selection. It should be noted that the width of the said selector L may vary in accordance with the different gauges of the textile machine and/or in accordance with other technical requirements that may arise.

Figure 2:
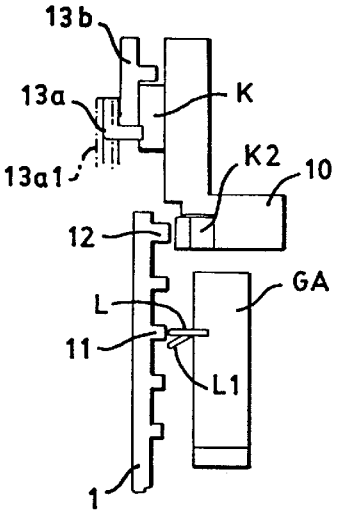
FIGS. 2 and 3 show two views of a selection arrangement.
Figure 3:
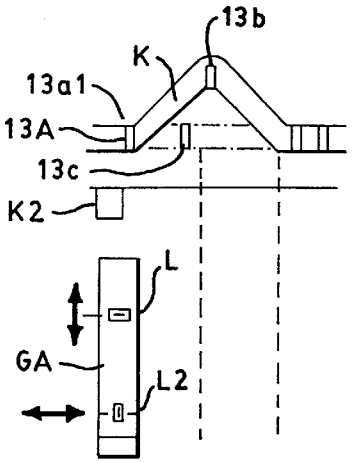
Figure 4:
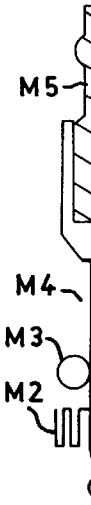
FIGS. 4, 5 and 6 show a further embodiment, in two operating conditions.
Figure 22:
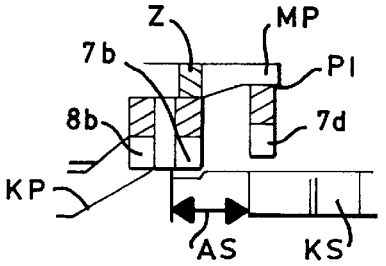
FIG. 22 show the operation of a permanent magnet.
Figure 21:
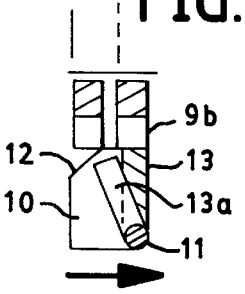
FIG. 21 show the operation of an oscillating selector.

Another important object of the invention is achieved by modifying the position and/or the travel and/or the function of the selector 13 acting on the butts of the jacks, FIGS. 16–18–20–21, which is similar to L–L2 in FIGS. 2 and 3. According to the invention, the said selector oscillates laterally, in other words horizontally through the space which is necessary for the correct outward movement of the selected jack and/or in any case sufficient to prevent errors of selection. It is therefore possible to use the said selection members both for the initial design and by the different positioning of the electromagnet and/or other similar member, such as a piezo-ceramic strip, or the keeper of one or more electromagnets duly prepared and strengthened, oscillating at high speed for the individual selection of the jack, providing an alternative method to the conventional single-magnet device, and illustrated schematically in FIG. 21 at 13–13*a* hinged on 11 and acting on the selection butt 9*b*, which, being pushed into the cylinder, forces the corresponding butt 7*b* and/or 8*b* to follow the permanent magnet MP into position 7*d* in FIG. 22. The letters KP indicate optional preselection cams for the butts 7 and 8, while As indicates the selection area, comprising both the thickness of the selector 13 and the part of the path subject to the action of the permanent magnet MP, before the raising cam KS. The above description, which is necessarily schematic, is in any case subject to variations and/or additional embodiments, owing to the considerable flexibility of the invention. It is obviously applicable to Jacquard machines in general, including mechanical ones, but the invention is fully applicable in a machine initially provided with electronic selection, for example one with electrical actuators incorporated in a single support, complete with cams for the control of the jacks, under-needles, sinkers, and/or needles and subsequently capable of assuming different technical and textile characteristics according to the circumstances. Within the same industrial sector, for example that of knitted fabrics, the machine in question changes needle selection from two to three technical ways; from 48 to 60 or 72 feeds or vice versa with the predispositions and/or arrangements suitable for each case, as known to those skilled in the art. The present description is for guidance only: parts and/or functions may vary according to the multiple possible embodiments and/or applications included or falling within the concept and/or purposes of the invention.

BRIEF DESCRIPTION OF THE FIGURES

The relative simplicity of the invention, which will be evident to those skilled in the art, requires rather simple and schematic drawings. In Sheet 1, FIG. 1 shows the jack 1, oscillating as shown at la, provided with spring(s) M1 and M2, or M3, with the lower end 2, the selection butt 11, the preselection butt 12 and the raising butt 13 of the under-needle 3 inserted and guided vertically, as shown by the arrow F, in its housing. FIG. 2 shows in section the jack 1 against the actuator unit GA which houses the moving selector, active at L and inactive at L1 against the butts 11. The cam support 10 houses the preselection cam K2 against the butts 12 and the raising cam K for the butts 13, which are disposed behind the cam K at 13*a*1; are partially on the cam K at 13*a*; and are raised at 13*b*. FIG. 3 is a schematic frontal view of the cam K, the incoming butt 13*a* and/or 13*a*1, the butt 13*c* behind the cam K, and the butt 13*b* on its apex. The preselection cam K2 is in line with the actuator unit GA which houses the selector oscillating vertically L or oscillating horizontally as at L2. FIG. 4 shows the jack 1 provided with various springs M1–M2–M3–M4 and/or with the under-needle 3 which is structurally elastic at M5. FIG. 5 is a plan view of the three butts of the jack 1, co-ordinated with respect to the preselection cam K2, the raising cam K and the protection-preselection cam K3, with the selector L1 in the selection area AS. FIG. 6 differs from FIG. 5 in that it shows the non-selection of the butts 13*c*, caused by the action of the selector L against 11*a*.

Figure 7:
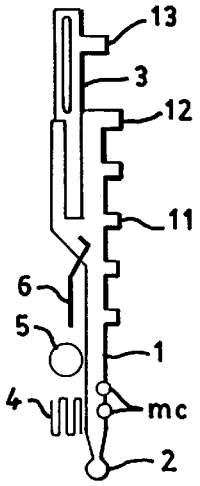
FIGS. 7 to 11 show a corresponding number of alternative embodiments.
Figure 8:
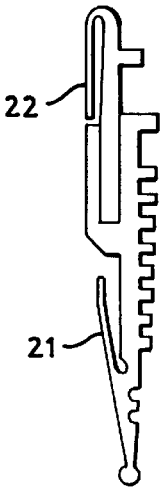
Figure 14:
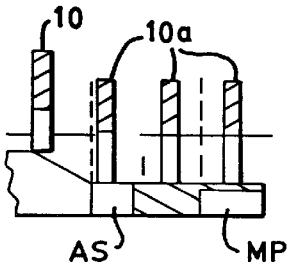
FIG. 14 show the selection operated bymeans of permanent magnets.
Figure 15:
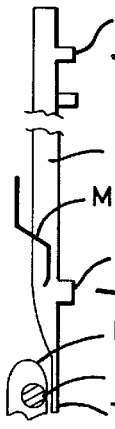
FIGS. 15, 16 and 17 show a different embodiment of the jack, a mobile selector and a lifting cam.
Figure 16:
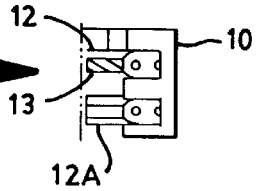
Figure 17:
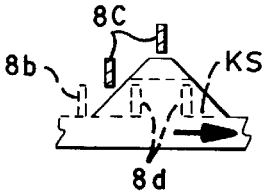
Figure 18:
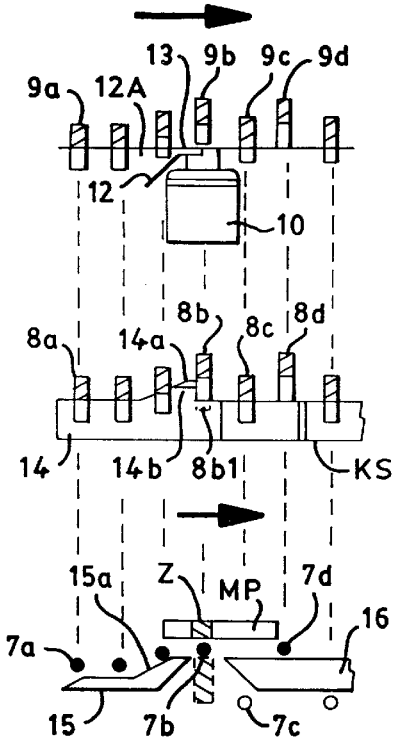
FIG. 18 show an arrangement of pre-selection cams.

In Sheet 2, FIGS. 7 and 8 show the jack 1 with the cylinder spring mc and some variants relating to the under-needle 3, as well as the presence of elastic zigzags or appendages 21 and 22 which are disposable in various ways. FIGS. 9, 10 and 11 show a different jack 1, essentially pivoted in the middle lower part 30, 26 and 3 so that both its ends oscillate. In relation to the different embodiments, this pivot is disposed directly against the cylinder 30 or provided by the functional connection of the jack 1 to other members (25-2) housed in the cylinder. The lower butt 10 is retained by a permanent magnet MP immediately following the selection area; alternatively the lower appendage 9 is also used for the selection with the single-magnet device 20 and with the aid of cams K6 and K7 in FIG. 10 and cams K4 and K5 in FIG. 12, where the energized coil 21 temporarily demagnetizes the bearing plane on which run the appendages 9 and 9*a*, which are diverted to the new position 9*b*. FIG. 13 is a plan view of the butts 10–11–12–13 of the said jack in relation to the preselection cam K2, the raising cam K, the control cam K3 and the 25 selector L, which is inactive in this case. If it is activated against 11*a*, the butts 13 pass behind the raising cam K, while the lower butts 10 are retained by the permanent magnet MP in the position 10*a*, as shown in FIG. 14. In Sheet 3, FIG. 15 shows a different type of jack 5, oscillating at the lower end 7, provided with spring(s) M1–M2–M3 and/or structurally elastic, provided with a raising butt 8, selection butts 9 and a preselection point or butt 7. FIG. 16 shows the moving selector 13 in the support or actuator unit 10, provided with an common inclined plane 12 and/or an individual inclined plane 12A. The said inclined plane 12, which is vertical, parallel to the cylinder, and continuous and/or segmented, protects the actuator and/or the individual selectors from any broken jacks, with the further function of a stop device in case of contact with these jacks. When suitably disposed, it becomes a preselection cam similar to 14*a* and 15*a* in FIG. 18. The vertical, lateral or horizontal position or displacement of the selector 13 permits the automatic expulsion of the jack 5 from the needle bed. FIG. 17 is a frontal view of the raising cam KS in relation to the incoming raising butt 8*b*, which rises as at 8*c*, or remains behind the cam KS in the position 8*d*. FIG. 18 is a plan view of the position of the incoming butts 7–8–9 at 7*a*–8*a*–9*a*, up to the selection area 7*b*–8*b*–9*b* from which they are diverted as at 7*c*–8*c*–9*c* or continue as at 7*d*–8*d*–9*d*. The lower butt or appendage 7, having passed the selection area Z, continues to be retained by the contact with the permanent magnet MP, with evident advantages. The jack 5 shown in FIG. 19 differs from the similar jack in FIG. 15 in that it is structurally elastic at M, and is also provided, if necessary, with another spring such as M1. Its lower end oscillates, following the preselection cam KP, and is retained if necessary by the permanent magnet MP, both of these being disposed at the lower end 7. It is provided with the butt 8 for the raising cam KS and selection butts 9. Its functions are shown schematically in FIG. 20: the incoming jack 7*a*–8*a*–9*a* is diverted inwards to the position 7*b*–8*b*–9*b*, the selection area Z. The selector 13, being inactive against 9*b*, does not impede the automatic outward movement of the compressed jacks which meet the raising cam KS. Conversely, with the selector L acting against the butt 9*b*, the butt 7*b* and/or 8*b* remains behind the raising cam KS, being attracted and/or maintained where specified by the force of the adjacent permanent magnet MP, which, being provided also with inclined plane(s) P.I., performs functions of active selection, in other words such that it modifies the path of the jack, removing it from the raising cam KS, contributing to a reduction in the selection area Z to the nominal gauge, or to the reduction of the width of the horizontally oscillating selector as shown at 13–13*a* in FIG. 21, hinged at 11 and acting against the butt 9*b*, which, being pushed into the cylinder, forces the corresponding butt 7*b* and/or 8*b* to follow the permanent magnet MP to position 7*d* in FIG. 22. Finally, the letters KP indicate two different preselection cams, for the butts 7 arid/or 8, while AS indicates the selection area, comprising both the thickness of the selector 13 and the part of the path subject to the action of the permanent magnet MP before the raising cam KS.

What is claimed is:

1. A method for Jacquard selection in a knitting machine, including the steps of:

providing at least one needle bed;

providing in said needlebed mobile parts for the formation of fabric and at least one selector means, for the selection of said mobile parts;

providing at least one counteracting member which counteracts the action of said selector means;

selecting at least some of said mobile parts and causing the selected mobile parts to slide in the needle bed by means of at least one raising cam;

pushing all said mobile parts by a pre-selection cam inside said needle bed in a pre-selected position; and said selector means cause the selected pa to move outwards from said needle bed in order to co-operate with said raising cam, while non-selected parts are kept out of contact with said raising cam.

2. An equipment for Jacquard selection in a knitting machine, including:

at least one needle bed equipped with mobile parts for the formation of fabric;

at least one selector means for selection of said mobile parts;

at least one counteracting member which counteracts action of said selector means;

at least one raising cam for moving the selected mobile parts;

characterized by a pre-selection cam for moving said mobile parts within the needle bed in a pre-selected position, said selector means causing the selected parts to move outside said needle bed, under the action of said counteracting member, in order to co-operate with said raising cam, said pre-selection cam being arranged upstream of said selector means with respect to relevant movement between said selector means and said pre-selection cam and said needle cylinder.

3. Equipment for Jacquard selection in a knitting machine provided with at least one needle bed equipped with needles, sinkers, jacks, under-needles, or other moving parts contributing to the formation of knitted fabric, characterized in that at least one actuator or selector of the mechanical or electromechanical type interacts with said moving parts or suitably shaped jacks having intrinsic structural elasticity and being automatically preselected by at least one cam having an inclined plane capable of compressing the said members in the needle bed or cylinder, in order to permit their subsequent automatic outward movement, or to prevent totally or partially said outward movement by means of frontal contraposition, according to an operating or design program.

4. A method for Jacquard selection in a textile machine, the method including the steps of:

providing a needle bed with a plurality of mobile parts for formation of fabric, said mobile parts being movable between an inner and outer position with respect to said needle bed;

biasing said plurality of mobile parts toward said outer position;

sequentially moving all of said plurality of mobile parts past a preselection cam to move said plurality of mobile parts towards said inner position;

moving said plurality of mobile parts past a selector after said sequential moving;

selectively operating said selector for passing individual ones of said plurality of mobile parts into said outer position by said biasing;

raising said individual ones of said plurality of mobile parts by a raising cam, said selective operating of said selector blocking non selected individual ones of said plurality of mobile parts from engagement with said raising cam.

5. Method according to claim 1, characterized in that in said pre-selected position said mobile parts are almost but not completely clear off said raising cams and that the non-selected parts are moved further inside the needle bed by said selection means, while the selected parts move back in an outward position where they are acted upon by said raising cam (K).

6. Equipment according to claim 2, wherein:

said pre-selection cam is designed such that it moves the mobile parts in a position wherein the mobile parts are partly and not completely clear off said raising cam and that said selector means moves un-selected mobile parts further inside the needle cylinder.

7. Equipment according to claim 2, characterized in that said counteracting means include at least one spring member.

8. Equipment according to claim 7, characterized in that said mobile parts each include at least one pre-selection butt, at least one selection butt and a raising butt, said counteracting means pushing the mobile parts in a position wherein said butts project from said needle bed toward said pre-selection cam, said raising cam and said selector means.

9. Equipment according to claim 2, characterized in that said counteracting means include at least one magnetic means.

10. Equipment according to claim 2, characterized in that said mobile parts include a jack which is designed to oscillate with respect to said needle cylinder, and an under-needle which is designed to oscillate along with said jack and to slide with respect to said jack, said jack being provided with a preselection butt cooperating with said pre-selection cam and at least one selection butt cooperating with said selector means, and that said under-needle is provided with a raising butt cooperating with said raising cam.

11. Equipment according to claim 10, characterized in that said jack is provided with a selection butt cooperating with a magnet.

12. Equipment according to claim 2, characterized by a protecting cam arranged immediately upstream of the selector means.

13. Equipment according to claim 3, characterized in that, when the constraining action of the preselection cam or other inclined planes ceases, the members contributing to the selection of the design move out automatically from the needle bed before the raising cam or the diverting cam;

or, with the corresponding selection butts of the jacks still "embedded" in the needle bed, even if only partially, are prevented from doing so by the frontal and opposing presence or absence of the selector, actuator or keeper or other selection means according to an operating or design program.

14. Equipment according to claim 3, characterized in that the contact between the moving (incoming) members of the needle bed and the selection means or selectors, takes place frontally, with the butts of the jacks completely or partially "embedded" in the needle bed.

15. Equipment according to claim 3, characterized in that the or cam tracks also have permanent magnet parts or inserts capable of retaining or maintaining the jacks or other moving and slidable parts in contact, or of diverting their path or position.

16. Equipment according to claim 3, characterized in that the selection of the jacks or similar parts is carried out by means of one or more selectors which are movable or oscillating, possibly horizontally as shown by 13–13*a* in FIG. 21.

17. Equipment according to claim 3, characterized in that the normal moving selector of the electromagnet has no frontal selector (plunger), the functions of this element being performed by the moving keeper of the electromagnet or other suitably prepared and strengthened selector(s).

18. Equipment according to claim 3, characterized in that the action or non-action of the selectors or other selection means takes place without the normal lateral impact with the butts of the jacks.

19. Equipment according to claim 3, characterized in that the actuator unit is provided with an inclined plane for each selector, this inclined plane being parallel to the cylinder and capable of guiding the jacks or other incoming parts of the needle bed;

such inclined plane if connected to the electrical circuit of the machine, acts as a stop device on contact with the cylinder or parts housed therein.

20. Equipment according to claim 3, characterized in that the selection of the jack, and other moving parts takes place by means of the presence or absence and function of the selector by frontal opposition or contraposition with respect to the said parts, such as a butt, or lateral appendage(s) or other end(s).

* * * * *